US008787785B2

(12) United States Patent
Matsumoto

(10) Patent No.: US 8,787,785 B2
(45) Date of Patent: Jul. 22, 2014

(54) IMAGE FORMING DEVICE AND CONTROL METHOD THEREOF

(75) Inventor: Hiroshi Matsumoto, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 12 days.

(21) Appl. No.: 13/459,462

(22) Filed: Apr. 30, 2012

(65) Prior Publication Data

US 2012/0294639 A1 Nov. 22, 2012

(30) Foreign Application Priority Data

May 17, 2011 (JP) ..... 2011-110256

(51) Int. Cl.
*G03G 15/20* (2006.01)

(52) U.S. Cl.
USPC ..... 399/67; 399/45

(58) Field of Classification Search
USPC ..... 399/45, 67, 122, 320, 328, 330
See application file for complete search history.

(56) References Cited

U.S. PATENT DOCUMENTS

| | | | | |
|---|---|---|---|---|
| 5,323,216 | A | 6/1994 | Mahoney | |
| 7,013,107 | B2 * | 3/2006 | Russel et al. | 399/328 |
| 2005/0271432 | A1 | 12/2005 | Chiba | |
| 2010/0303495 | A1 | 12/2010 | Kurosu | |
| 2011/0013936 | A1 * | 1/2011 | Fujii | 399/122 |

FOREIGN PATENT DOCUMENTS

JP 2006-91224 A 4/2006

OTHER PUBLICATIONS

Namihana et al., JP 2006091224 English translation, Apr. 2006.*
United States Patent and Trademark Office, Office Action for U.S. Appl. No. 13/459,543, dated Oct. 3, 2013.
United States Patent and Trademark Office, Office Action for U.S. Appl. No. 13/459,543, dated Mar. 3, 2014.

* cited by examiner

*Primary Examiner* — David Gray
*Assistant Examiner* — Thomas Giampaolo, II
(74) *Attorney, Agent, or Firm* — Cantor Colburn LLP

(57) ABSTRACT

An image forming device includes: an image forming section, a fixing unit, an oscillation mechanism and a controller. The image forming section forms an image on paper. The fixing unit thermally fixes the image on the paper by using a fixing rotating member to pinch and convey the paper. The oscillation mechanism oscillates at least the entire fixing rotating member of the fixing unit in an axis direction thereof. The controller determines an oscillation quantity of the fixing rotating member based on rigidity of the paper in a state where the paper is pinched and conveyed by the fixing rotating member and another rotating member at the same time, and oscillates the fixing rotating member using the oscillation mechanism with the determined oscillation quantity. The controller determines the oscillation quantity of the fixing rotating member to be reduced as rigidity of the paper becomes lower.

6 Claims, 7 Drawing Sheets

FIG.3

301

| WEIGHT OF PAPER (SUBSTITUTE VALUE OF RIGIDITY) :g/m2 | less than 100 | 101 to 176 | 177 to 256 | 257 to 300 | more than 301 |
|---|---|---|---|---|---|
| FIRST OSCILLATION QUANTITY :mm/sec | 0.05 | 0.06 | 0.08 | 0.1 | 0.15 |
| SECOND OSCILLATION QUANTITY :mm/sec | 0.06 | 0.08 | 0.1 | 0.15 | 0.2 |
| THIRD OSCILLATION QUANTITY :mm/sec | 0.08 | 0.11 | 0.15 | 0.2 | 0.25 |

IMAGE FORMING DEVICE AND CONTROL METHOD THEREOF

BACKGROUND OF THE INVENTION

1. Field of the Invention

The present invention relates to an image forming device and a control method thereof.

2. Description of Related Art

Conventionally, in an image forming device, a fixing unit is used for fixing an image formed on paper. A fixing unit thermally fixes an image on paper by pinching and conveying the paper on which the image is already formed, by using a fixing rotating member provided with heating unit such as a halogen lamp heater inside thereof. As such a fixing rotating member, a pair of rollers including a heating roller having heating unit and a pressure roller, a fixing belt extended between a pair of rollers, or the like is used.

In the conventional fixing unit, paper passes through a same area of the fixing rotating member, which causes a scar in an area of the fixing rotating member which comes in contact with a side end section of paper (hereinafter referred to as a paper end), and the scar deteriorates quality of images. To solve this problem, a technique has been proposed for preventing paper from passing through a same area of a fixing rotating member by oscillating the fixing rotating member in the axis direction thereof, in other words, in the direction orthogonal to a paper conveying direction (for example, refer to the Japanese Unexamined Patent Application Publication No. 2006-91224).

There has been a problem that, when the fixing rotating member oscillates while paper is pinched and conveyed by a pair of rollers of a fixing unit and another pair of rollers at the same time, a defect such as misalignment of an image, a wrinkle of paper or the like happens.

SUMMARY OF THE INVENTION

An object of the present invention is to prevent a defect such as misalignment of images, a wrinkle of paper, or the like caused by oscillation of a fixing rotating member in an image forming device.

To achieve at least one of the abovementioned objects, an image forming device reflecting one aspect of the present invention includes: an image forming section to form an image on paper; a fixing unit to thermally fix the image on the paper by using a fixing rotating member to pinch and convey the paper on which the image has been formed by the image forming section; an oscillation mechanism to oscillate at least the entire fixing rotating member of the fixing unit in an axis direction thereof; and a controller to determine an oscillation quantity of the fixing rotating member based on rigidity of the paper in a state where the paper is pinched and conveyed by the fixing rotating member and another rotating member at the same time, and oscillate the fixing rotating member using the oscillation mechanism with the oscillation quantity which has been determined, wherein the controller determines the oscillation quantity of the fixing rotating member to be reduced as rigidity of the paper becomes lower.

Preferably, the oscillation quantity of the fixing rotating member in the state where the paper is pinched and conveyed by the fixing rotating member and another rotating member at the same time is determined to be smaller than the oscillation quantity of the fixing rotating member in a state where the paper is pinched and conveyed only by the fixing rotating member and the oscillation quantity of the fixing rotating member in a state where the paper is not pinched and conveyed by the fixing rotating member.

Preferably, the controller controls a compressing force of conveying rollers provided on a downstream side of the fixing rotating member in a paper conveying direction when the paper is pinched and conveyed by the fixing rotating member, so that the compressing force is smaller than a compressing force of the conveying rollers when the paper is not pinched and conveyed by the fixing rotating member.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 3 is a view showing an example of an oscillation quantity table stored in a storage section shown in FIG. 1;

FIG. 6A shows the relation thereof between T3 and T4 of FIG. 5, FIG. 6B shows the relation thereof between T4 and T5 of FIG. 5, and FIG. 60 shows the relation thereof at T6 of FIG. 5 and thereafter.

DESCRIPTION OF THE PREFERRED EMBODIMENTS

A structure and operation of an image forming device according to an embodiment of the present invention will be explained in detail using the drawings. Although the embodiment of the present invention will be explained taking a color image forming device 1 as an example, the present invention is not limited thereto, and a black-and-white image forming device, for instance, is also be able to achieve the present invention.

Figure 1:
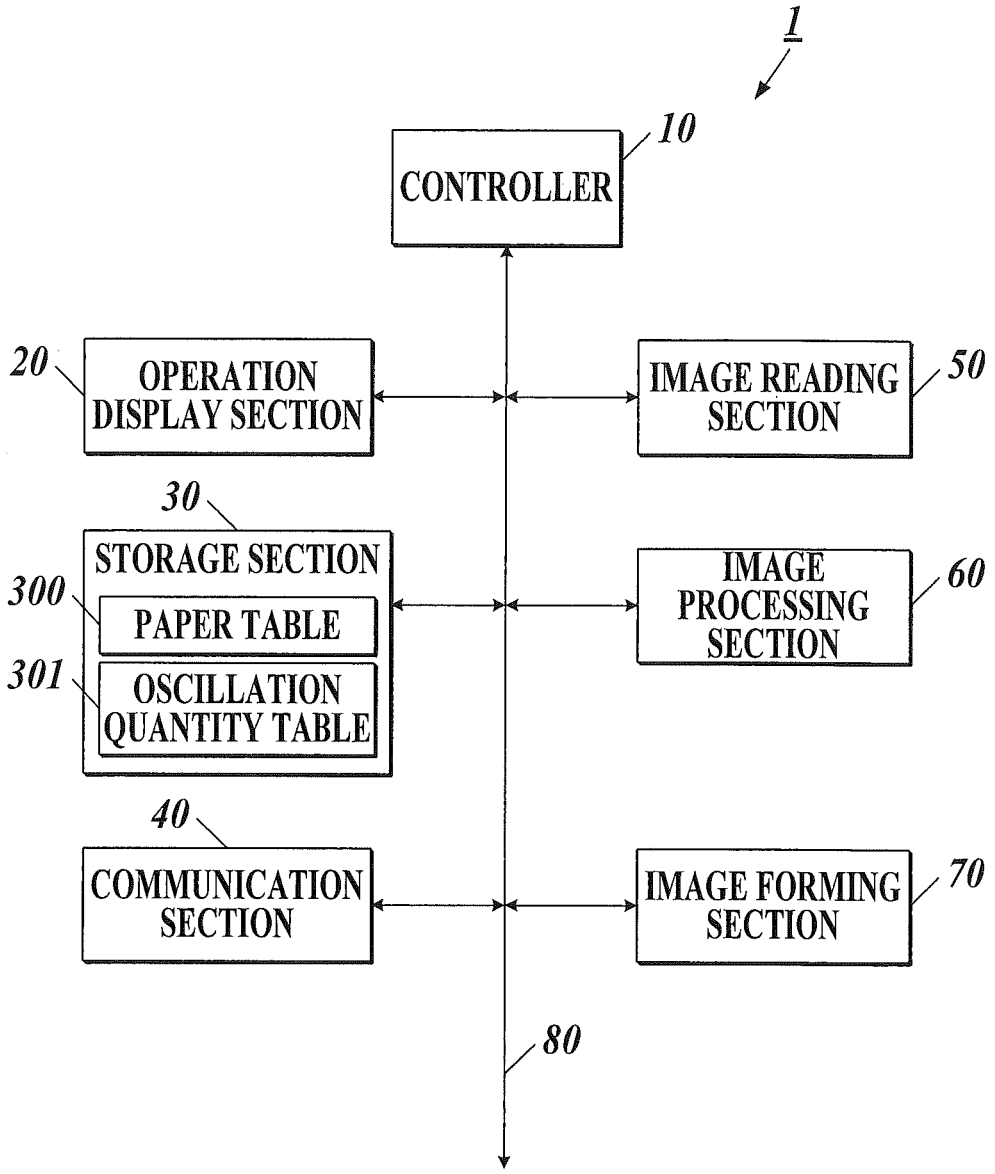
FIG. 1 is a block diagram showing a functional structure of an image forming device according to an embodiment of the present invention.
Figure 2:
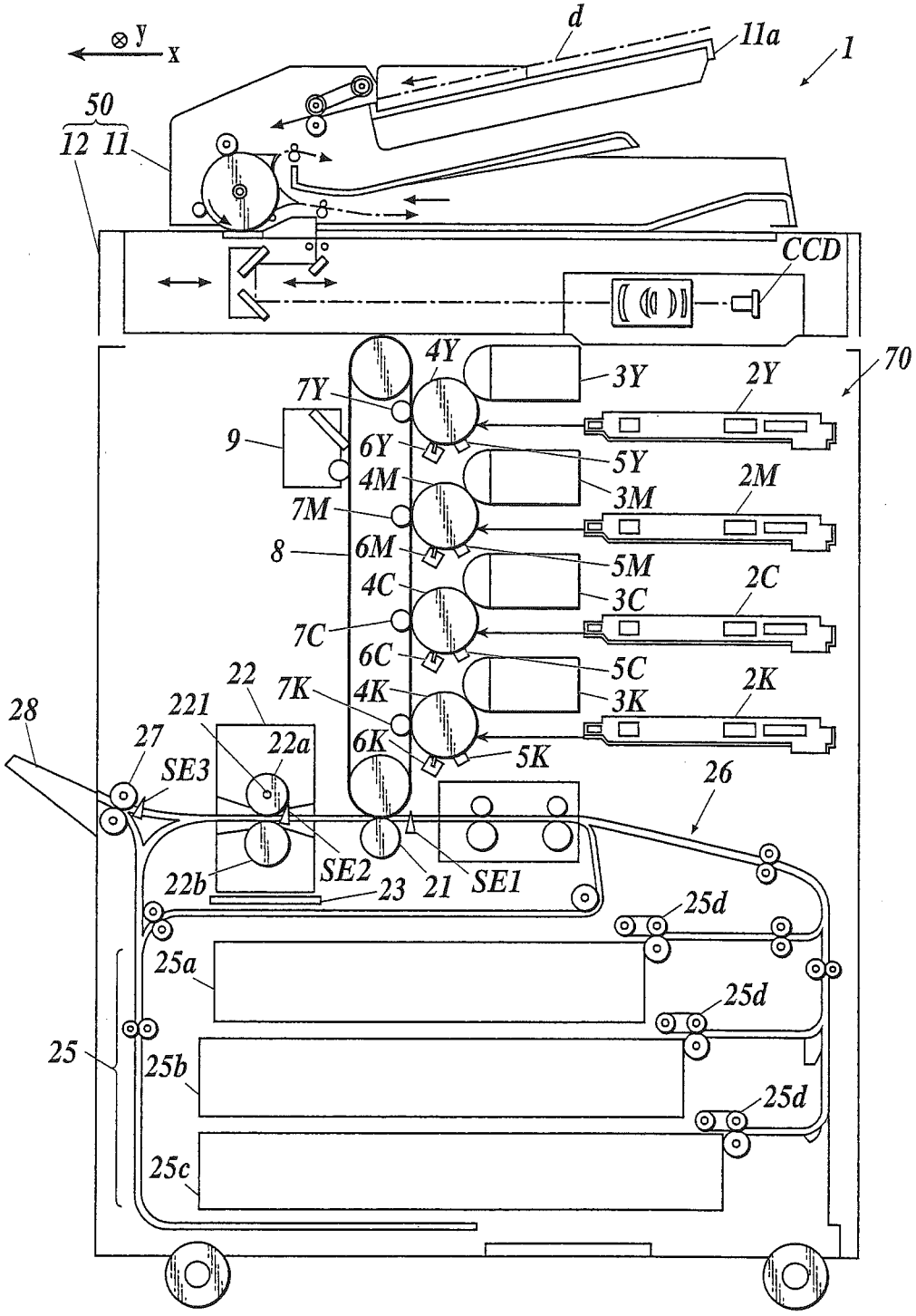
FIG. 2 is a view showing an example of a rough structure of the image forming device.

FIG. 1 illustrates an example of a functional block diagram of an image forming device 1. FIG. 2 illustrates an example of a rough structure of the inside of the image forming device 1.

As depicted in FIG. 1, the image forming device 1 is constructed of elements including a controller 10, an operation display section 20, a storage section 30, a communication section 40, an image reading section 50, an image processing section 60, and an image forming section 70, and each of these sections is connected to each other through a bus 80.

The controller 10 is constructed of a CPU (central processing unit), a RAM (random access memory), and the like. The CPU of the controller 10 reads out a system program and various processing programs stored in the storage section 30, expands the programs in the RAM, and performs centralized control of the operation of each of the sections of the image forming device 1 in accordance with expanded programs.

For example, by collaborating with a program stored in the storage section 30, the controller 10 makes the image reading section 50 read an image from a document placed on a document tray 11*a*, carries out a job based on job information such as the image read from the document and image forming conditions inputted from the operation display section 20, forms the image on paper P, and outputs the same. Also, by collaborating with a program stored in the storage section 30, the controller 10 receives, from the communication section 40, job information including the image data sent from an external device or the like and image forming conditions for each of the image data, carries out a job based on the job information received, forms an image on paper P, and outputs the same.

Here, the image forming conditions include a type and size of paper P and the like which is used for image forming.

Further, the controller 10 performs oscillation control for an oscillation mechanism 23 by collaborating with a program stored in the storage section 30.

The operation display section 20 is constructed of a LCD (liquid crystal display) or the like, and displays various operation buttons, a state of the device, a run state of each function, or other information on a display screen thereof in accordance with an instruction of a display signal inputted from the controller 10. The display screen of the LCD is covered by a pressure sensitive (resistive) touch panel constructed by transparent electrodes arranged in a grid-like form, detects a X-Y coordinate of a point of load pressed by a finger or a touch pen as a voltage value, and outputs a detected location signal to the controller 10 as an operation signal. The operation display section 20 further includes various operation buttons such as number buttons and a start button, and outputs an operation signal to the controller 10 by operating a button.

The storage section 30 is structured of a nonvolatile memory or the like, and stores a system program executable in the image forming device 1, various processing programs executable in the system program, data used when executing the various processing programs, data of processing result which has been arithmetically processed by the controller 10, and the like.

In this embodiment, the storage section 30 stores a paper table 300, and an oscillation quantity table 301.

The paper table 300 stores a type of paper and an index value which indicates rigidity of the paper (weight of paper ($g/m^2$) is used here) which are in correspondence with each other. The correspondence relation between the type of paper and an index value indicating rigidity of paper can be set using the operation display section 20.

As illustrated in FIG. 3, the oscillation table 301 is a table which stores the index value which indicates rigidity of paper (weight of paper is used here), a first oscillation quantity, a second oscillation quantity, and a third oscillation quantity based on the rigidity of paper, which are in correspondence with each other. The first oscillation quantity is an oscillation quantity of the fixing unit 22 when paper having the rigidity is pinched and conveyed at two points or more by the pair of rollers of the fixing unit 22 and another pair of rollers at the same time (the oscillation quantity is expressed as an oscillation quantity per second; hereinafter the same). The second oscillation quantity is an oscillation quantity of the fixing unit 22 when paper having the rigidity is pinched and conveyed only by the fixing unit 22. The third oscillation quantity is an oscillation quantity of the fixing unit 22 when paper having the rigidity is not pinched and conveyed by the fixing unit 22. The relation among the first to third oscillation quantities for each rigidity of paper is expressed as the first oscillation quantity<the second oscillation quantity<the third oscillation quantity.

Here, the rigidity of paper represents a value indicating resistivity of the paper when a bending force is applied thereto, and the lower the paper rigidity is, the lower the toughness of the paper is and the more susceptible to wrinkles the paper becomes. Also, the larger paper rigidity is, the higher the toughness of the paper is and more resistant to wrinkles the paper becomes. Therefore, in the oscillation quantity table 301, the relation between paper rigidity and oscillation quantity is defined so that an oscillation quantity becomes smaller as paper rigidity gets lower. In the example described here uses a weight of paper as the index value indicating paper rigidity, but the index value may also be expressed as paper rigidity itself.

The impact of oscillation of the fixing unit 22 on the paper P depends not only on paper rigidity, but also on a distance between the fixing rotating member (here, the pair of rollers of the fixing unit 22; the heating roller 22*a* and the pressure roller 22*b*) and another rotating member (pair of rollers). Hence, the content of the oscillation quantity table 301 varies depending on a model of the image forming device 1.

Further, the storage section 30 stores a compressing force of delivery rollers 27 while paper is pinched and conveyed by the pair of rollers of the fixing unit 22, as well as a compressing force of the delivery rollers 27 while paper is not pinched and conveyed by the pair of rollers of the fixing unit 22.

The communication section 40 is structured of a modem, a LAM adaptor, a router and the like, carries out communication control with an external device such as a PC (personal computer) connected to a communication network including LAN (local area network), WAN (wide area network) and the like, and receives job information and the like.

As illustrated in FIG. 2, the image reading section 50 is provided with an automatic document feeding section 11 which is known as an ADF (auto document feeder), and a reading section 12. The automatic document feeding section 11 conveys a document d placed on the document tray 11*a* to a contact glass where the document d is read. The reading section 12 projects light to the document d that has been placed on the contact glass, acquires an image signal of the document d by reading reflected light using a CCD (charge coupled device) and performing photoelectric conversion, and outputs the image signal to the image processing section 60.

The image processing section 60 carries out various image processing such as A/D conversion, shading correction, image compression, on the image (an analog image signal) outputted by the image reading section 50, and thereafter, separates colors into Y (yellow), M (magenta), C (cyan), and K (black), before outputting the image as digital image data to the image forming section 70.

The image forming section 70 forms an image using an electro photographic method on paper P which has been conveyed by a paper feeding section 25, based on the inputted image data. As illustrated in FIG. 2, the image forming section 70 is constructed of exposure units 2Y, 2M, 2C, and 2K, development units 3Y, 3M, 3C, and 3K, photosensitive drums 4Y, 4M, 4C, and 4K, charging sections 5Y, 5M, 5C, and 5K, cleaning sections 6Y, 6M, 6C, and 6K, primary-transfer rollers 7Y, 7M, 7C, and 7K, an intermediate transfer belt 8, a belt cleaning section 9, secondary-transfer rollers 21, the fixing unit 22, the oscillation mechanism 23, the paper feeding section 25, and a conveying section 26 including the delivery rollers 27.

Each of the exposure units 2Y, 2M, 2C, and 2K is structured of elements including a laser light source such as a LD, a polygon mirror, and a plurality of lenses. The exposure units 2Y, 2M, 2C, and 2K perform scanning exposure on the surfaces of the photosensitive drums 4Y, 4M, 4C, and 4K using a laser beam based on image data sent from the image processing unit 60. Due to this scanning exposure with the laser beam, latent images are formed, in other words, the images are written, to the image forming positions of the photosensitive drums 4Y, 4M, 4C and 4K which are charged by the charging sections 5Y, 5M, 5C, and 5C. The image forming positions of the photosensitive drums 4Y, 4M, 4C and 4K are positions on the photosensitive drums where latent images are formed.

The latent images formed on the photosensitive drums 4Y, 4M, 4C, and 4K are then formed into visible images by development carried out by the corresponding development units 3Y, 3M, 3C, and 3K, and the toner image is formed on each of the photosensitive drums 4Y, 4M, 4C, and 4K.

Primary transfer of the toner images formed on and supported by the photosensitive drums 4Y, 4M, 4C, and 4K are carried out by being transferred sequentially to predetermined positions on the intermediate transfer belt 8 by the primary-transfer rollers 7Y, 7M, 7C and 7K.

The cleaning sections 6Y, 6M, 6C, and 6K remove residual toner from the surfaces of the photosensitive drums 4Y, 4M, 4C and 4K, respectively, which have finished transferring the toner images.

The intermediate transfer belt 8 is a semi conductive endless belt which is suspended on and rotatably supported by a plurality of rollers, and is driven to rotate along rotation of the rollers.

This intermediate transfer belt 8 is compressed onto the photosensitive drums 4Y, 4M, 4C, and 4K by the primary-transfer rollers 7Y, 7M, 7C and 7K, respectively. Thus, the toner images respectively developed on the surfaces of the photosensitive drums 4Y, 4M, 4C, and 4K are sequentially transferred onto the intermediate transfer belt 8 by the primary-transfer rollers 7Y, 7M, 7C and 7K, respectively (primary transfer). Meanwhile, paper P of a type instructed by the controller 10 is fed in the paper feeding section 25, and conveyed by the conveying section 26 to a position where the images are transferred by the secondary-transfer rollers 21. Then, the toner images of the color image are transferred to the paper P at the position where the images are to be transferred by the secondary-transfer rollers 21, as the pair transfer rollers 21 pinches and conveys the paper P (secondary transfer). After the transfer, the paper P is conveyed by the fixing unit 22, the toner images transferred to the paper P are thermally fixed, and delivered on the delivery tray 28 by the delivery rollers 27. The delivery rollers 27 are conveying rollers located on the downstream side of the fixing unit 22 in the paper conveying route. Residual toner on the intermediate transfer belt 8 is removed by the belt cleaning section 9.

On the conveying route of the conveying section 26, a plurality of photo sensors are provided as detecting unit for detecting a position of paper P. The detecting unit includes a secondary transfer paper detection sensor SE1 for detecting whether paper P is present in a nip section of the secondary-transfer rollers 21, a fixing unit paper detection sensor SE2 for detecting whether paper P is present in a nip section of the fixing unit 22, and a delivery roller paper detecting sensor SE3 for detecting whether paper P is present in a nip section of the delivery rollers 27. The controller 10 determines a location and a conveying state of paper P based on outputs from these photo sensors and controls a motion of each section of the image forming section 70.

The fixing unit 22 includes a fixing rotating member such as a pair of rollers that are the heating roller 22*a* and the pressure roller 22*b*. The fixing rotating member is a rotating member for pinching and conveying paper on which an image is already formed, while heating the same. In addition to the abovementioned pair of rollers, a fixing belt or the like may be used for the fixing rotating member.

The heating roller 22*a* is provided with heating unit such as halogen lamp heater, extending in the axis direction thereof. The heating roller 22*a* rotates by being driven by non-illustrated rotation drive unit such as a motor. The pressure roller 22 b is compressed to the heating roller 22*a* by being driven by non-illustrated compressing drive unit such as a solenoid, and forms a fixing nip between the pressure roller 22*b* itself and the heating roller 22*a*. At this time, the pressure roller 22*b* rotates along with rotation of the heating roller 22*a*. Thus, the heating roller 22*a* and the pressure roller 22*b* heat and press paper P while pinching and conveying the same with the fixing nip thereof, and carry out fusing fix of a toner image on the paper P. Drive control of the rotation drive unit and the compressing drive unit are performed by the controller 10.

As the heating unit 221, in addition to a halogen lamp heater, an induction heater or a resistance heating element may also be used.

Here, when paper P passes through the fixing unit 22, an end of the paper P comes in contact with the fixing rotating member (in this embodiment, the heating roller 22*a*) of the fixing unit 22. Therefore, if paper P passes through the same place each time, an end of paper causes a scratch, which degrades quality of an image. Thus, in the image forming device 1, the oscillation mechanism 23 is provided beneath the fixing unit 22, and by allowing the oscillation mechanism 23 to oscillate the entire fixing unit 22 in a y direction (the axis direction of the fixing rotating member) orthogonal to the conveying direction x of paper P, paper P is prevented from passing through the same place of the heating roller 22*a*.

Figure 4:
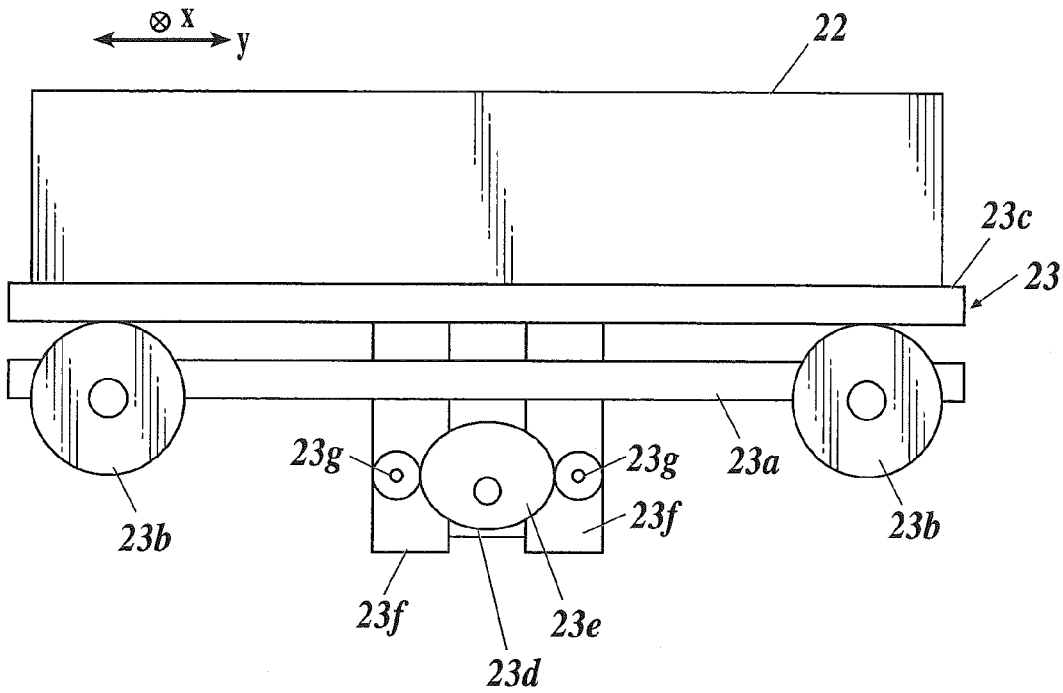
FIG. 4 is a view showing an example of a rough structure of an oscillation mechanism of a fixing unit.

FIG. 4 schematically shows an example of a rough structure of the oscillation mechanism 23. In FIG. 4, the direction x from the front to the back is the conveying direction of paper P, and the direction y orthogonal to this conveying direction is the direction of oscillation. As illustrated in FIG. 4, the oscillation mechanism 23 includes a base 23*a* fixed inside of the image forming device 1, a pair of support rollers 23*b* rotatably provided with respect to the base 23*a*, and an oscillation plate 23*c* which bridges between the pair of support rollers 23*b* and on which the fixing unit 22 is mounted.

The base 23*a* is provided with a first projecting section 23*d* extending downward. To this first projection section 23*d*, an eccentric cam 23*e* is attached in a rotatable manner. Meanwhile, the oscillation plate 23*c* is provided with a pair of second projecting sections 23*f*, extending downward. In these second projecting sections 23*f*, a pair of oscillation rollers 23*g* is attached in a rotatable fashion, sandwiching the eccentric cam 23*e* in the direction of oscillation. The pair of oscillation rollers 23*g* abuts on the eccentric cam 23*e*, and as the eccentric cam 23*e* rotates due to driving of a non-illustrated motor, the second projecting sections 23*f* follow the rotation and oscillate in the direction of oscillation. This means that, since the oscillation reaches the oscillation plate 23*c* through the second projecting sections 23*f*, the oscillation plate 23*c* and the entire fixing unit 22 also oscillate in the direction of oscillation. Drive control of the motor for rotating the eccentric cam 23*e* is carried out by the controller 10. The oscillation width of the fixing unit 22 is, for example, approximately +/−6 mm. This oscillation width may be changed appropriately depending on fixing conditions and purposes, but should be larger than variation in passing position of paper (up to approximately +/−2 mm).

Here, when the fixing unit 22 is oscillated by the oscillation mechanism 23 in a state where paper P is pinched and conveyed by the pair of rollers of the fixing unit 22 and another pair of rollers at the same time, a problem such as misalignment of an image and wrinkling of paper occurs. The problem depends on rigidity of paper P.

Figure 5:
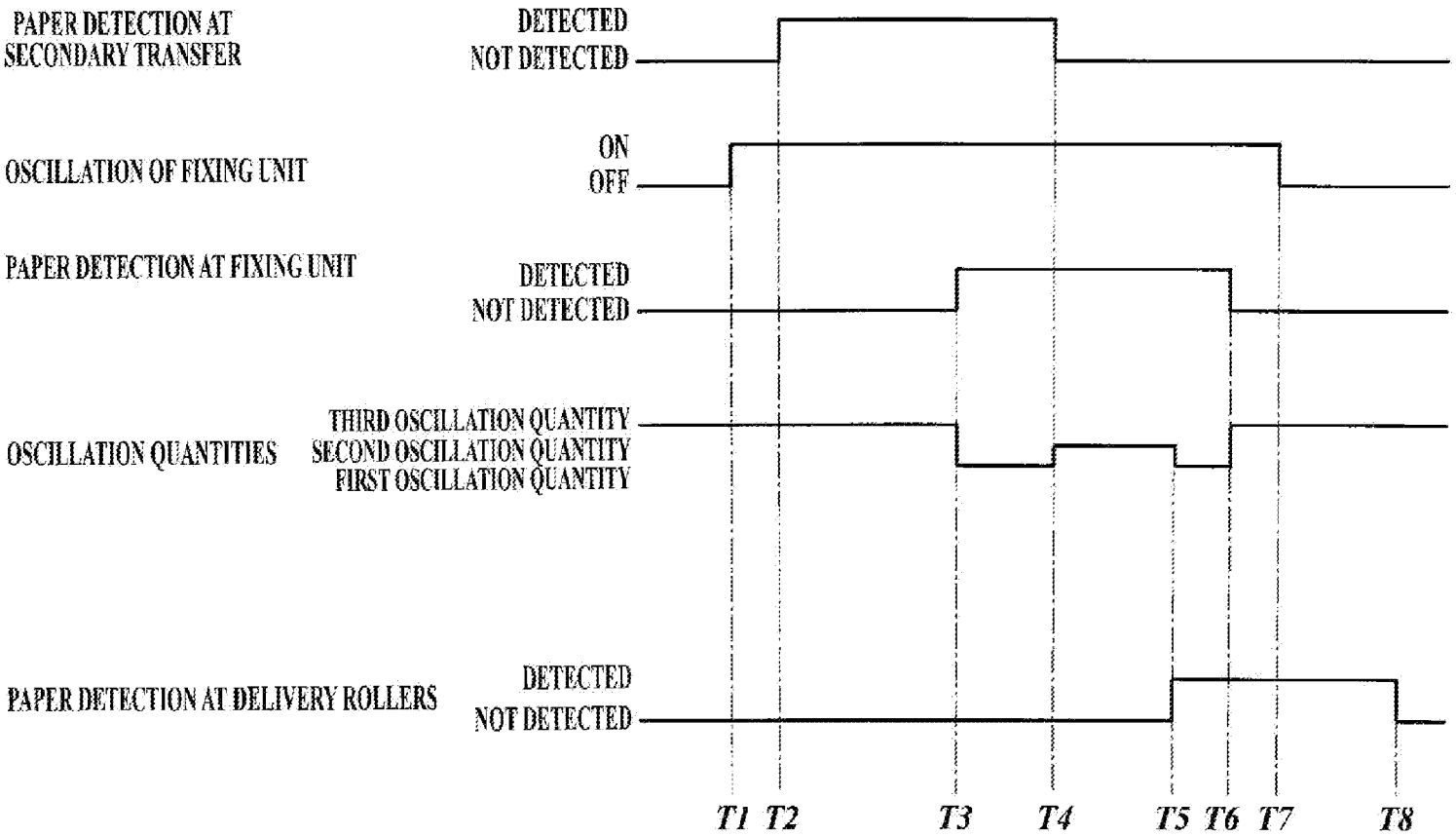
FIG. 5 is a timing chart concerning control of oscillation for the fixing unit carried out by a controller shown in FIG. 1.

Therefore, when paper P is pinched and conveyed by the pair of rollers of the fixing unit 22 and another pair of rollers at the same time, the control unit 10 controls the quantity of oscillation of the fixing unit 22 (to be smaller than the oscillation quantity when paper P is pinched and conveyed only by the pair of rollers of the fixing unit 22, and when paper P is not pinched and conveyed by the fixing unit 22) in accordance with rigidity of paper P, by controlling the oscillation mechanism 23 as shown in the timing chart of FIG. 5.

T1 shown in FIG. 5 represents timing to begin execution of a job. T2 represents timing where an end of paper P which has been fed from the paper feeding section 25 reaches the nip section of the secondary-transfer rollers 21 and an output of the secondary transfer paper detection sensor SE1 changes from a signal which indicates that no paper is detected (for example, "0") to a signal which indicates that paper is detected (for example, "1"). T3 represents timing where an end of paper P reaches the nip section of the fixing unit 22, and an output of the fixing unit paper detection sensor SE2 changes from a signal which indicates that there is no paper detected (for example, "0") to a signal which indicates that paper is detected (for example, "1"). T4 represents timing where a rear end of paper P passes through the secondary-transfer rollers 21, and an output of the secondary transfer paper detection sensor SE1 changes from a signal indicating that paper is detected to a signal indicating that there is no paper detected. T5 represents timing where an end of paper P reaches the nip section of the delivery rollers 27, and an output of the delivery roller paper detection sensor SE3 changes from a signal indicating that there is no paper detected (for example, "0") to a signal indicating that there is paper detected (for example, "1"). T6 represents timing where a rear end of paper P passes through the fixing unit 22, and an output of the fixing unit paper detection sensor SE2 changes from a signal indicating that paper is detected to a signal showing that there is no paper detected. T8 represents timing where a rear end of paper P passes through the delivery rollers 27, and an output of the delivery roller paper detection sensor SE3 changes from a signal indicating that paper is detected to a signal indicating that no paper is detected.

In FIG. 5, once execution of a job begins (T1), the controller 10 starts oscillation of the fixing unit 22 by driving the oscillation mechanism 23. More specifically, the controller 10 refers to a type of paper included in information of the job being executed, and the paper table 300 and the oscillation table 301 stored in the storage section 30, and acquires the third oscillation quantity in accordance with the rigidity of paper P used for the job. Then, the controller 10 controls the oscillation mechanism 23 to oscillate the fixing unit 22 with the third oscillation quantity which has been acquired.

As an end of the paper P reaches the secondary-transfer rollers 21, an output of the secondary transfer paper detection sensor SE1 changes from a signal indicating that no paper is detected to a signal indicating that paper is detected (T2). Further, as the end of the paper P reaches the fixing unit 22, an output of the fixing unit paper detection sensor SE2 changes from a signal indicating that no paper is detected to a signal indicating that paper is detected (T3). Then, the controller 10 determines that the paper P is pinched and conveyed by the secondary-transfer rollers 21 and the pair of rollers of the fixing unit 22 at the same time, and controls the oscillation mechanism 23 to change an oscillation quantity of the fixing unit 22 to the first oscillation quantity. More specifically, the controller 10 refers to a type of paper included in information of the job being executed, and the paper table 300 and the oscillation table 301 stored in the storage section 30, and acquires the first oscillation quantity in accordance with the rigidity of paper P used for the job. Then, the controller 10 controls the oscillation mechanism 23 to oscillate the fixing unit 22 with the first oscillation quantity which has been acquired.

Figure 6A:
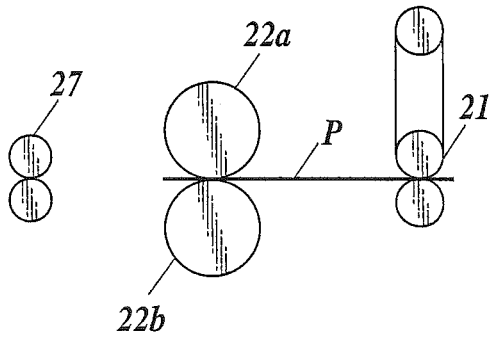
FIGS. 6A to 6C are views showing relations among paper, secondary-transfer rollers, a pair of rollers of the fixing unit, and delivery rollers, where

FIG. 6A shows a relation among paper P, the secondary-transfer rollers 21, the heating roller 22*a* and the pressure roller 22*b* of the fixing unit 22, and the delivery rollers 27 between T3 and T4 shown in FIG. 5. As shown in FIG. 6A, between T3 and T4 of FIG. 5, paper P is pinched and conveyed simultaneously by the secondary-transfer rollers 21 and the pair of rollers of the fixing unit 22, and the fixing unit 22 is oscillated with the first oscillation quantity which is the smallest.

Once the rear end of the paper P passes through the secondary-transfer rollers 21 and an output of the secondary transfer paper detection sensor SE1 changes from a signal indication that paper is detected to a signal indicating that no paper is detected (T4), the controller 10 determines that the paper P is pinched and conveyed only by the pair of rollers of the fixing unit 22, and controls the oscillation mechanism 23 to change the oscillation quantity of the fixing unit 22 to the second oscillation quantity. To be more specific, the controller 10 refers to a type of paper included in information of the job being executed, and the paper table 300 and the oscillation table 301 stored in the storage section 30, and acquires the second oscillation quantity in accordance with the rigidity of paper P used for the job. Then, the controller 10 controls the oscillation mechanism 23 to oscillate the fixing unit 22 with the second oscillation quantity which has been acquired.

Figure 6B:
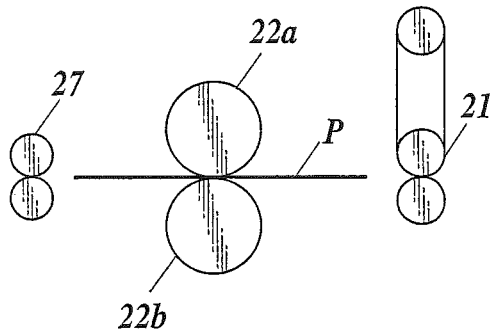

FIG. 6B shows a relation among paper P, the pair of the secondary-transfer rollers 21, the pair of rollers of the fixing unit 22 (the heating roller 22*a* and the pressure roller 22*b*), and the pair of delivery rollers 27 between T4 and T5 shown in FIG. 5. As illustrated in FIG. 6B, between T4 and T5 of FIG. 5, paper P is pinched and conveyed only by the pair of rollers of the fixing unit 22, and the fixing unit 22 is oscillated with the second oscillation quantity.

Once an end of paper P reaches the delivery rollers 27 and an output of the delivery roller paper detection sensor SE3 changes from a signal indicating that no paper is detected to a signal indicating that paper is detected (T5), the controller 10 determines that the paper P is pinched and conveyed by the pair of rollers of the fixing unit and the delivery rollers 27 at the same time, and controls the oscillation mechanism 23 to change the oscillation quantity of the fixing unit 22 to the first oscillation quantity. To be more specific, the controller 10 refers to a type of paper included in information of the job being executed, and the paper table 300 and the oscillation table 301 stored in the storage section 30, and acquires the first oscillation quantity in accordance with the rigidity of paper P used for the job. Then, the controller 10 controls the oscillation mechanism 23 to oscillate the fixing unit 22 with the first oscillation quantity which has been acquired.

Once the rear end of the paper P passes through the fixing unit 22 and an output of the fixing unit paper detection sensor SE2 changes from a signal indicating that paper is detected to a signal indicating that no paper is detected (T6), the controller 10 determines that the paper P is not pinched and conveyed by the pair of rollers of the fixing unit 22, and controls the oscillation mechanism 23 to change the oscillation quantity of the fixing unit 22 to the third oscillation quantity. More specifically, the controller 10 refers to a type of paper included in information of the job being executed, and the paper table 300 and the oscillation table 301 stored in the storage section 30, and acquires the third oscillation quantity in accordance with the rigidity of paper P used for the job. Then, the controller 10 controls the oscillation mechanism 23 to oscillate the fixing unit 22 with the third oscillation quantity which has been acquired.

Figure 6C:
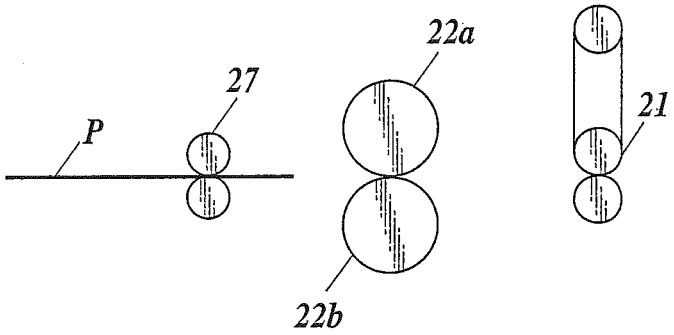

FIG. 6C shows a relation among paper P, the secondary-transfer rollers 21, the heating roller 22*a* and the pressure roller 22*b* of the fixing unit 22, and the delivery rollers 27 at T6 and after shown in FIG. 5. As illustrated in FIG. 6C, at T6 and later shown in FIG. 5, the paper P is pinched and conveyed only by the delivery rollers 27, in other words, the paper P is not pinched and conveyed by the fixing unit 22. Thus, the fixing unit 22 is oscillated with the third oscillation quantity which is the largest.

After a given period of time after the rear end of the paper P passed through the fixing unit 22 (T7), the controller 10 stops driving the oscillation mechanism 23 to stop oscillation of the fixing unit 22.

With the controller 10 which performs control based on above-explained timing chart illustrated in FIG. 5, the fixing unit 22 is oscillated with the first oscillation quantity in accordance with rigidity of paper P while the paper P is pinched and conveyed by the pair of rollers of the fixing unit 22 and another pair of rollers at the same time (between T3 and T4, and between T5 and T6). Hence, in a state where the paper P is pinched and conveyed by the pair of rollers of the fixing unit 22 and another pair of rollers at the same time and the paper P may easily have misalignment of an image or get wrinkled, the oscillation quantity of the fixing unit 22 can be reduced to prevent wrinkling if a type of paper P has lower rigidity and is wrinkled more easily, and the oscillation quantity is increased to secure as much oscillation as possible for the fixing unit 22 if the type of paper P has larger rigidity and is not wrinkled so easily.

Also, the first oscillation quantity while the paper P is pinched and conveyed by the pair of rollers of the fixing unit 22 and another pair of rollers at the same time, is smaller than the second oscillation quantity while the paper P is conveyed by the fixing unit 22 only (T4 to T5) and the third oscillation quantity while the paper P is not conveyed by the fixing unit 22 (T1 to T3, and T6 to T7). Therefore, in a state where the paper P is pinched and conveyed by the pair of rollers of the fixing unit 22 and another pair of rollers at the same time and the paper P may easily have misalignment of an image or get wrinkled, the oscillation quantity of the fixing unit 22 is controlled to be smaller than oscillation quantities the other states. Thus, misalignment of an image and wrinkling of paper due to oscillation of the fixing unit 22 can be prevented.

Further, in this embodiment, the fixing unit 22 is oscillated with an oscillation quantity depending on rigidity of paper P while the paper P is conveyed only by the fixing unit 22 (T4 to T5) as well as the paper P is not conveyed by the fixing unit 22 (T1 to T3 and T6 to T7). Therefore, the oscillation quantity can be controlled meticulously depending on whether the paper P can be wrinkled easily. Also, since the oscillation quantity is controlled so that the first oscillation quantity<the second oscillation quantity<the third oscillation quantity is realized, the oscillation quantity can be controlled more meticulously depending on whether the state of conveying of the paper P makes the paper P wrinkled easily due to oscillation of the fixing unit 22.

The timing chart shown in FIG. 5 represents a case where one page of an image is formed by the job. If an image is formed by a job on paper sequentially, oscillation of the fixing unit 22 continues until a given period of time elapses after the last paper of the job passes through the fixing unit 22.

Figure 7:
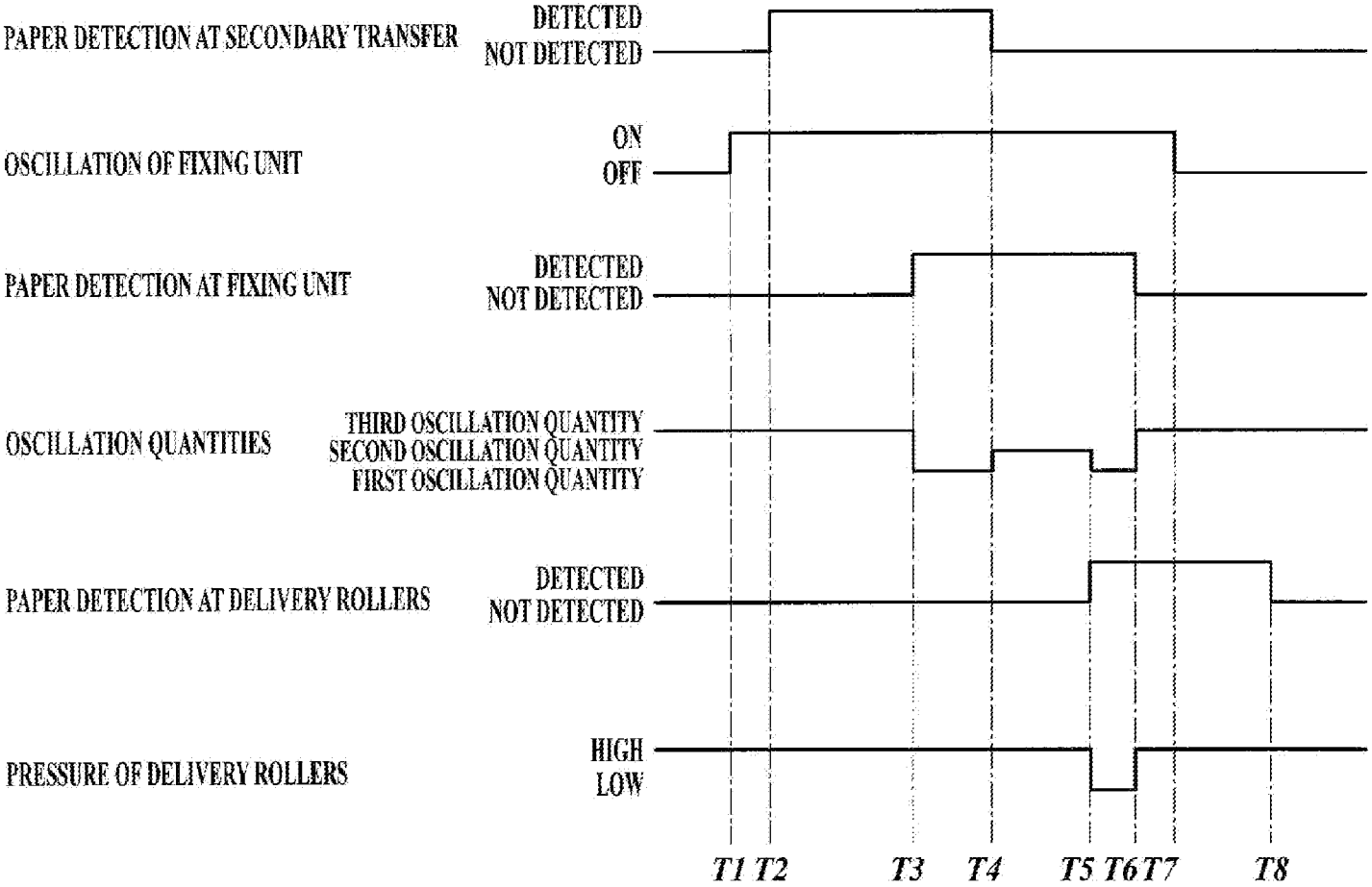
FIG. 7 is a timing chart when control of compression force of the pair of rollers of the fixing unit is performed in addition to the control of oscillation for the fixing unit.

Here, like the timing chart shown in FIG. 7, while both the fixing unit paper detection sensor SE2 and the delivery roller paper detection sensor SE3 output a signal which indicates that paper is detected (T5 to T6), it is preferable that the controller 10 controls the compressing drive unit of the delivery rollers 27 to reduce a compressing force of the delivery rollers 27. When paper P is pinched and conveyed by the pair of rollers of the fixing unit 22, the paper P is conveyed even if a compressing force of the delivery rollers 27 is small (or does not exist). Also, when a compressing force is strong at both the fixing unit 22 and the delivery rollers 27, paper P is pulled hard by both of the nip sections thereof and is easily wrinkled due to oscillation of the fixing unit 22. However, if a compressing force is small (or does not exist) at either the fixing unit 22 or the delivery rollers 27, the paper P will be in almost the same state as being conveyed only by another pair of rollers, and becomes difficult to be wrinkled even when the fixing unit 22 oscillates. So, when the paper P is pinched and conveyed by both the pair of rollers of the fixing unit 22 and the delivery rollers 27, wrinkles of paper can be prevented more definitely by reducing a compressing force of the delivery rollers 27 (for example, 2.0N to 0.5N or smaller) to be smaller than the compressing force of the same when paper P is not pinched and conveyed by the pair of rollers of the fixing unit 22 and the delivery rollers 27, or by eliminating the compressing force of the same.

As explained so far, according to the image forming device 1, the controller 10 refers to the oscillation quantity table 301 stored in the storage section 30, determines an oscillation quantity of the fixing unit 22 based on rigidity of paper P, and controls the oscillation mechanism 23 so that the heating roller 22*a* and the pressure roller 22*b* of the fixing unit 22 are oscillated with the oscillation quantity which has been determined. To be more specific, the controller 10 determines an oscillation quantity so that the oscillation quantity becomes smaller as rigidity of paper P becomes lower. Therefore, in a state where the paper P is pinched and conveyed by the pair of rollers of the fixing unit 22 and another pair of rollers at the same time and the paper P may easily have misalignment of an image or get wrinkled, the oscillation quantity of the fixing unit 22 is controlled to be smaller when a type of paper P is low in rigidity and thus gets wrinkled more easily, thus preventing paper from being wrinkled. In addition, when a type of paper P is high in rigidity and is not wrinkled easily, the oscillation quantity is controlled to become larger, enabling to secure as much oscillation quantity of the fixing unit 22 as possible.

Also, the controller 10 determines the first oscillation quantity which is used while paper P is pinched and conveyed by the pair of rollers of the fixing unit 22 and another pair of rollers at the same time so that the first oscillation quantity becomes smaller than the second oscillation quantity which is used while paper P is conveyed only by the fixing unit 22 and the third oscillation quantity which is used while paper P is not conveyed by the fixing unit 22. Hence, in a state where the paper P is pinched and conveyed by the pair of rollers of the fixing unit 22 and another pair of rollers at the same time and the paper P may easily have misalignment of an image or get wrinkled, the oscillation quantity of the fixing unit 22 is controlled to be smaller than those in the other states. Thus, misalignment of an image and wrinkles of paper due to oscillation of the fixing unit 22 can be prevented.

Furthermore, the controller 10 controls a compressing force of the delivery rollers 27 when paper P is pinched and conveyed by the pair of rollers of the fixing unit 22 so that the compressing force becomes smaller than the compressing force used when paper P is not pinched and conveyed by the pair of rollers of the fixing unit 22. Therefore, compression by the delivery rollers 27 is reduced when paper P can be conveyed with a conveying force of the fixing rotating member without needing a conveying force of the delivery rollers 27, thus enabling to prevent wrinkles of paper more definitely.

It should be noted that the description of the above embodiment shows one of preferred examples of the image forming device according to this invention, and the present invention shall not be limited thereto.

For example, explained as an example in the aforementioned embodiment was the case where the entire fixing unit 22 is oscillated in the axis direction thereof. However, the invention of this application is not limited thereto, and, as long as the oscillation mechanism of the fixing rotating member is provided which at least oscillates the fixing rotating member as a whole in the axis direction thereof, the invention of the present application can be achieved by controlling oscillation of the fixing rotating member through controlling the oscillation mechanism as the timing charts shown in FIG. 5 or 7.

Further, the structure of the image forming device 1 was described that an image is formed on paper by the secondary-transfer rollers using the intermediate transfer belt. However, the structure of the same may be such that a toner image formed on a photoreceptor is directly formed on paper by transfer rollers.

Yet further, an example of the above description includes, but not limited to, a ROM, a nonvolatile memory, a hard disk, or the like as a computer-readable medium for programs according to the present invention. As one of other computer-readable media, a portable storage medium such as CD-ROM may be applicable. Also, as a medium for providing data of a program according to the present invention through a communication line, a carrier wave may be applied.

The other details of the structure and operation of the image forming device 1 may also be changed as appropriate without departing from the scope and spirit of the present invention.

The entire disclosure of Japanese Patent Application No. 2011-110256 filed on May 17, 2011 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An image forming device, comprising:

an image forming section to form an image on paper;

a fixing unit to thermally fix the image on the paper by using a fixing rotating member to pinch and convey the paper on which the image has been formed by the image forming section;

an oscillation mechanism to oscillate at least the entire fixing rotating member of the fixing unit in an axis direction thereof;

another rotating member to pinch and convey the paper, the another rotating member being provided on an upstream side or a downstream side of the fixing unit in a paper conveying direction; and a controller to determine an oscillation quantity of the fixing rotating member based on rigidity of the paper in a state where the paper is pinched and conveyed by the fixing rotating member and the another rotating member, and oscillate the fixing rotating member using the oscillation mechanism with the oscillation quantity which has been determined, wherein the controller determines the oscillation quantity of the fixing rotating member to be reduced as rigidity of the paper becomes lower.

2. The image forming device according to claim 1, wherein the oscillation quantity of the fixing rotating member in the state where the paper is pinched and conveyed by the fixing rotating member and the another rotating member is determined to be smaller than an oscillation quantity of the fixing rotating member in a state where the paper is pinched and conveyed only by the fixing rotating member and an oscillation quantity of the fixing rotating member in a state where the paper is not pinched and conveyed by the fixing rotating member.

3. The image forming device according to claim 1 wherein the controller controls a compressing force of conveying rollers provided on the downstream side of the fixing rotating member in the paper conveying direction when the paper is pinched and conveyed by the fixing rotating member, so that the compressing force is smaller than a compressing force of the conveying rollers when the paper is not pinched and conveyed by the fixing rotating member.

4. A control method of an image forming device which includes an image forming section to form an image on paper, a fixing unit to thermally fix the image on the paper by using a fixing rotating member to pinch and convey the paper on which the image has been formed by the image forming section, an oscillation mechanism to oscillate at least the entire fixing rotating member of the fixing unit in an axis direction thereof, and another rotating member to pinch and convey the paper, the another rotating member being provided on an upstream side or a downstream side of the fixing unit in a paper conveying direction, said control method comprising the steps of:

determining an oscillation quantity of the fixing rotating member in a state where the paper is pinched and conveyed by the fixing rotating member and the another rotating member so that the oscillation quantity is reduced when rigidity of the paper becomes lower; and oscillating the fixing rotating member with the determined oscillation quantity by using the oscillation mechanism.

5. The control method according to claim 4, wherein the oscillation quantity of the fixing rotating member in the state where the paper is pinched and conveyed by the fixing rotating member and the another rotating member is determined to be smaller than an oscillation quantity of the fixing rotating member in a state where the paper is pinched and conveyed only by the fixing rotating member and an oscillation quantity of the fixing rotating member in a state where the paper is not pinched and conveyed by the fixing rotating member.

6. The control method according to claim 4, further comprising a step of controlling a compressing force of conveying rollers provided on the downstream side of the fixing rotating member in the paper conveying direction when the paper is pinched and conveyed by the fixing rotating member, so that the compressing force is smaller than a compressing force of the conveying rollers when the paper is not pinched and conveyed by the fixing rotating member.

* * * * *